United States Patent [19]

Okazaki et al.

[11] Patent Number: 4,839,269

[45] Date of Patent: Jun. 13, 1989

[54] LIGHT-RESPONSIVE MATERIAL CONTAINING A DYE COMPRISING TWO CYCLODEXTRIN GROUPS

[75] Inventors: Masaki Okazaki; Junichi Yamanouchi, both of Kanagawa, Japan

[73] Assignee: Fuji Photo Film Co., Ltd., Kanagawa, Japan

[21] Appl. No.: 97,894

[22] Filed: Sep. 17, 1987

[30] Foreign Application Priority Data

Sep. 17, 1986 [JP] Japan ..... 61-219017

[51] Int. Cl.[4] ..... G03C 1/02; G03C 1/08; G03C 1/12; G03C 1/19

[52] U.S. Cl. ..... 430/570; 430/580; 430/583; 430/584; 430/585; 430/591; 430/592; 430/593; 430/599

[58] Field of Search ..... 430/82, 91, 92, 93, 430/94, 95, 570, 580, 584, 585, 591, 592, 593, 599, 510, 512

[56] References Cited

U.S. PATENT DOCUMENTS

| | | | |
|---|---|---|---|
| 3,063,838 | 11/1962 | Jennings | 430/570 |
| 4,283,488 | 8/1981 | Van Lare | 430/580 |
| 4,724,201 | 2/1988 | Okazaki et al. | 430/570 |

*Primary Examiner*—Paul R. Michl
*Assistant Examiner*—Patrick A. Doody
*Attorney, Agent, or Firm*—Sughrue, Mion, Zinn, Macpeak, and Seas

[57] ABSTRACT

A light-sensitive material comprising a dye containing two or more cyclodextrin groups or derivatives thereof wherein the dye may serve as a spectral sensitizer and optionally, a compound which fluoresces light of a wavelength which can be absorbed by the dye.

12 Claims, No Drawings

LIGHT-RESPONSIVE MATERIAL CONTAINING A DYE COMPRISING TWO CYCLODEXTRIN GROUPS

FIELD OF THE INVENTION

The present invention generally relates to a novel light-responsive material comprising a dye containing two or more cyclodextrin groups or derivatives thereof. Particularly, the present invention relates to a novel light-responsive material comprising, as a spectral sensitizer, a dye containing two or more cyclodextrin groups or derivatives thereof. The present invention also relates to a novel light-responsive material comprising a dye containing two or more cyclodextrin groups or derivatives thereof and a compound which fluoresces light of a wavelength which can be absorbed by said dye. More particularly, the present invention relates to a novel light-responsive material comprising, as spectral sensitizers, a dye containing two or more cyclodextrin groups or derivatives thereof, and a compound which fluoresces light of a wavelength which can be absorbed by said dye.

BACKGROUND OF THE INVENTION

A light-responsive material contains a dye for various purposes. One of these purposes is spectral sensitization.

In the field of silver salts photography, such a spectral sensitizing technique using a dye has been widely developed since it was discovered by H.W. Vogel in 1873. In the filed of photo voltaic effect, the application of such a technique has been studied since Sheppard and others announced their studies on a silver-silver bromide electrode in 1940. The spectral sensitization of a light-responsive material enables the extension of the wave range of light which is responsive to the light-responsive material or a restriction of the wave range to a desired range and therefore is an extremely important technique in the field of light-responsive materials. Thus, the study is spectral sensitization has been widely carried out. The study of the improvement in the spectral sensitizing effect has been of particularly great interest.

One of the methods for improving the spectral sensitizing effect is to increase the amount of the dye used and hence the light absorption so that the available amount of light can be increased. In this case, it goes without saying that an increase in the amount of the dye to be used in the spectral sensitization raises the light absorption. Unfortunately, the spectral sensitizing effect does not always increase proportionally with the amount of the dye used. The spectral sensitizing effect rather begins to drop at a certain point. This fact has been well known since Leermakers and others reported such in 1937. In order to eliminate such a disadvantage, it has been proposed to use spectral sensitizing dyes which are previously arranged in such an order that the farther they are located from the substrate the shorter is the wavelength of light absorbed by them so that the amount of light available for spectral sensitization can be increased (U.S. Pat. Nos. 3,662,317, 3,976,493, and 3,976,640).

However, the above-mentioned method is merely results in improvement in the arrangement of the dyes and thus is not necessarily satisfactory with respect to the spectral sensitization of certain wave ranged. It has therefore been desired to develop a light-responsive material having a spectral sensitivity improved by the use of a novel spectral sensitizer.

SUMMARY OF THE INVENTION

It is therefore an object of the present invention to provide a light-responsive material having an improved sensitivity.

It is another object of the present invention to provide a novel dye compound containing two or more cyclodextrin groups and derivatives thereof to achieve improved sensitivity.

These and other objects of the present invention will become more apparent from the detailed description of the invention provided hereinafter.

These objects of the present invention have been met by the use of a dye compound obtained by the introduction of two or more cyclodextrin groups into a dye and optionally, a compound which fluoresces light of a wavelength which can be absorbed by said dye.

DETAILED DESCRIPTION OF THE INVENTION

The present invention provides a light-responsive material comprising a dye containing two or more cyclodextrin groups or derivatives thereof. More preferably, the present invention provides light-responsive material comprising a dye containing two or more cyclodextrin groups or derivatives thereof and a compound which fluoresces light of a wavelength which can be absorbed by said dye.

Cyclodextrin groups which can be used in the present invention are compounds in which a number of D(+)-glucopyranose units are connected by the $\alpha$1,4-bond to form a ring. These compounds are prefixed by $\alpha$(6 units), $\beta$(7 units), $\gamma$(8 units), and so on depending on the number of glucose units constituting one molecule thereof so that they are referred to as "$\alpha$-cyclodextrin", "$\beta$-cyclodextrin", "$\gamma$-cyclodextrin", and so on, respectively. Among these compounds, $\alpha$, $\beta$, and $\gamma$-cyclodextrins are commercially available. These there compounds are also referred to as "cyclohexaamylose", "cycloheptaamylose" and "cyclooctaamylose", respectively. Furthermore, derivatives of these cyclodextrins obtained by substituted the hydroxyl groups there of with substituents such as ether groups, ester groups, amino groups, or the like are known. These cyclodextrins are described in detail in L. Bender and M. Komiyama, *Cyclodextrin Chemistry,* Springer-Verlag Corporation (1978).

Examples of dyes which can be used for the preparation of the present dye containing two or more cyclodextrin groups or derivatives thereof (CD-dye, hereinafter referred to as "dye compound") include cyanine dyes, merocyanine dyes, composite cyanine dyes, composite merocyanine dyes, holopolar cyanine dyes, hemicyanine dyes, styryl dyes, and hemioxonol dyes. particularly useful among these dyes are cyanine dyes, merocyanine dyes, composite cyanine dyes, and composite merocyanine dyes. These dyes can comprise any nucleus which are commonly used for cyanine dyes as a basic heterocyclic nucleus. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, a nucleus obtained by condensation of these nucleus with aliphatic hydrocarbon rings, and a nucleus obtained by condensation of these nuclei with aromatic hydrocarbon rings such as an indolenine nucleus, a benzindolenine nucleus, an indole nucleus, a benzoxazole nucleus, a naphthooxazole nucleus, a benzothiazole nucleus, a napththothiazole nucleus, a benzoselenazole nucleus, a benzimidazole nucleus, a napththoimidazole nucleus, a quinoline nucleus, and an imidazo[4,5-b]quinozaline nucleus. These nuclei may be substituted on the carbon atoms.

The merocyanine dyes or composite merocyanine dyes may comprise as nucleus having a ketomethylene structure 5-or 6-membered heterocyclic nucleus such as pyrazoline-5-one nucleus, a thiohydantoin nucleus, a 2-thiooxazolidine2,4-dione nucleus, a thiazolidine-2,4-dione nucleus, a rhodanine nucleus, a thiobarbituric acid nucleus, a 2-thioselenazolidine-2,4-dione nucleus, a pyrazolo[1,5-a]benzimidazole nucleus, and a pyrazolo[5,1-b]quinazolone nucleus.

Other examples of the present dyes include dyes as described in F.M. Hammer, *Heterocyclic Compounds—Cyanine Dyes and Related Compounds,* John Wiley & Sons Corporation (New York, London, 1964), azo dyes, anthraquinone dyes, and oxonol dyes.

The dye compounds to be used in the present invention are compounds in which two or more cyclodextrin groups or derivatives thereof are connected to a dye component by a linking group. The carbon atom in the position of the cyclodextrin group to which the dye component is preferably linked is a primary or secondary, particularly primary, hydroxyl group of the cyclodextrin. Such a structure is represented by general formula (I):

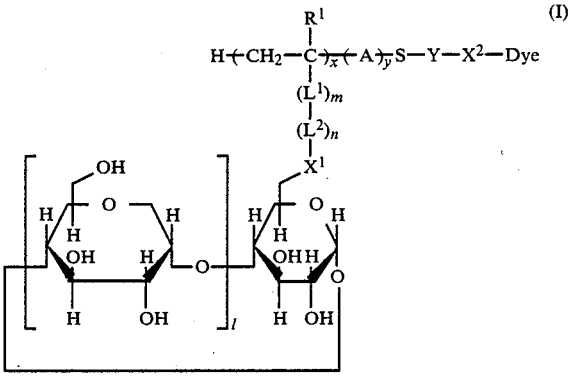

(I)

In general formula (I), the hydroxyl groups may be o-alkylated (e.g., methylated or ethylated) or o-acylated (e.g., acetylated or tosylated) or substituted by amino groups, alkylamino groups (e.g., methylamino groups) or acylamino groups (e.g., acetylamino groups).

In general formula (I), $X^1$ and $X^2$ may be the same or different and each represents O, S, or NR in which R represents a hydrogen atoms, a substituted or unsubstituted alkyl group (which may be substituted) containing 1 to 10 carbon atoms, an aryl group (which may be substituted) containing 6 to 10 carbon atoms, an aralkyl group (which may be substituted) containing 7 to 10 carbon atoms, or a univalent heterocyclic group. The suffix l represents an integer of 5 or more. Preferably, X represents a hydrogen atom or a methyl group. Y represents an alkylene group containing 1 to 4 carbon atoms, preferably an ethylene group or a propylene group.

$R^1$ represents a hydrogen atom, an alkyl group containing 1 to 4 carbon atoms or a chlorine atom, preferably represents a hydrogen atom or a methyl group; $L^1$ represents

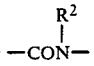

(in which $R^2$ represents a hydrogen atom, an alkyl group containing 1 to 4 carbon atoms or a substituted alkyl group containing 1 to 6 carbon atoms, preferably represents a hydrogen atom or a methyl group), —COO—, —NHCO—, —OCO—,

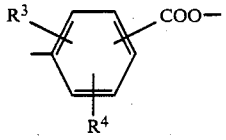

(in which $R^3$ and $R^4$ represents a hydrogen atom, a hydroxyl group, a halogen atom or a substituted or unsubstituted alkyl, alkoxy, acyloxy or aryloxy group containing 1 to 10 carbon atoms, preferably $R^3$ and $R^4$ represent a hydrogen atom), or

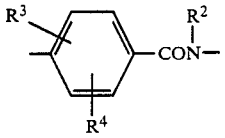

in which $R^2$, $R^3$ and $R^4$ are as defined above; $L^2$ represents a linking group which links $L^1$ to $X^1$, and m and n each represents an integer of 0 or 1.

A represents a monomer unit (copolymer component) derived from a copolymerizable ethylenically unsaturated monomer. The suffixes x and y each represents the content of the respective repeating unit. x is preferably in the range of 10 to 100% by weight. y is preferably in the range of 0 to 90% by weight.

The linking group represented by $L^2$ can be specifically represented by the formula:

$$\left[X^3\left(J^1-X^4\right)_p\left(J^2-X^5\right)_q\left(J^3\right)_r\right]_s$$

In the above formula, J1, $J^2$ and J3 may be the same or different and each represents —CO—, $—SO_2—$,

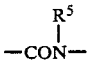

(in which $R^5$ represents a hydrogen atom, an alkyl group containing 1 to 6 carbon atoms, or a substituted alkyl group containing 1 to 6 carbon atoms, preferably $R^5$ represents a hydrogen atom or a methyl group),

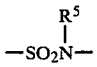

(in which $R^5$ is as defined above),

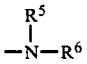

(in which $R^5$ is as defined above and $R^6$ represents an alkylene group containing 1 to about 4 carbon atoms, preferably $R^6$ represents an ethylene group or a propylene group),

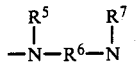

(in which $R^5$ and $R^6$ are as defined above and $R^7$ represents a hydrogen atom, an alkyl group containing 1 to 6 carbon atoms, or a substituted alkyl group containing 1 to 6 carbon atoms, preferably $R^7$ represents a hydrogen atom or a methyl group), —O—, —S—,

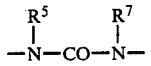

(in which $R^5$ and $R^7$ are as defined above),

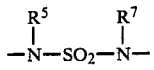

(in which $R^5$ and $R^7$ are as defined above), —COO—, —OCO—,

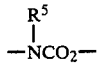

(in which $R^5$ is as defined above), or

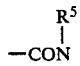

(in which $R^5$ is as defined above).

$X^3$, $X^4$, and $X^5$ may be the same or different and each represents an alkylene group, substituted alkylene group, arylene group, substituted arylene group, aralkylene group, or substituted aralkylene group.

The suffixes p, q, r and s each represents an integer of 0 or 1.

Referring further to $X^3$, $X^4$ and $X^5$, these groups may be the same or different and each may represent a $C_{1-10}$ substituted or unsubstituted straight-chain or branched alkylene group, aralkylene group, or phenylene group. Examples of such an alkylene group include a methylene group, a methylmethylene group, a dimethylmethylene group, a dimethylene group, a trimethylene group, a tetramethylene group, a pentamethylene group, a hexamethylene group, and a decylmethylene group. Examples of such an aralkylene group include a benzylidene group. Examples of such a phenylene group include a p-phenylene group, a m-phenylene group, and a methylphenylene group.

Examples of the substituents for the alkylene group, aralkylene group or phenylene group represented by $X^3$, $X^4$ or $X^5$ include a halogen atom, a nitro group, a cyano group, an alkyl group, a substituted alkyl group, an alkoxy group, a substituted alkoxy group, a group represented by —$NHCOR^8$ (in which $R^8$ represents an alkyl group, a substituted alkyl group, a phenyl group, a substituted phenyl group, an aralkyl group, or a substituted aralkyl group), a group represented by —$NHSO_2R^8$ (in which $R^8$ is as defined above), a group represented by —$SOR^8$ (in which $R^8$ is as defined above), a group represented by —$SO_2R^8$ (in which $R^8$ is as defined above), a group represented by

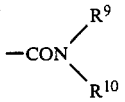

(in which R9 and $R^{10}$ may be the same or different and each represents a hydrogen atom, an alkyl group, a substituted alkyl group, a phenyl group, a substituted phenyl group, an aralkyl group, or a substituted aralkyl group), a group represented by

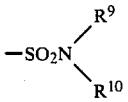

(in which $R^9$ and $R^{10}$ are as defined above), an amino group which may be substituted by an alkyl group, and a hydroxyl group or group which undergoes hydrolysis to form hydroxyl groups.

Examples of the substituents for the above mentioned substituted alkyl group, substituted alkoxy group, a substituted phenyl group, or substituted aralkyl group include a hydroxyl group, a nitro group, an alkoxy group containing 1 to 4 carbon atoms, a group represented by —$NHSO_2R^8$ (in which $R^8$ is as defined above), a group represented by —$NHCOR^8$ (in which $R^8$ is as defined above), a group represented by

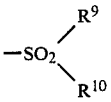

(in which $R^9$ and $R^{10}$ are as defined above), a group represented by

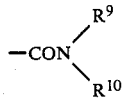

(in which $R^9$ and $R^{10}$ are as defined above), a group represented by —$SO_2R^8$ (in which $R^8$ is as defined above), a halogen atom, a cyano group, and an amino group which may be substituted by alkyl groups.

Examples of the dye compounds which may be used in the present invention are shown hereinafter, but the present invention should not be construed as being limited thereto. In the examples of the present dye compounds shown hereinafter, cyclodextrin groups of the formula:

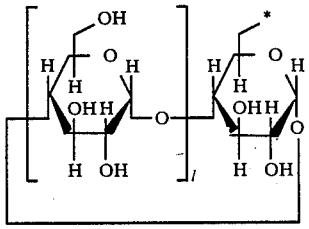

will be abbreviated depending on the number of l as follows:

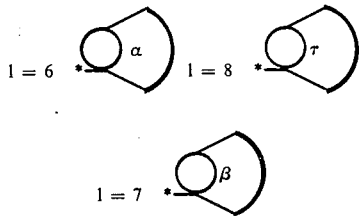

In the present invention, a dye containing two or more, preferably 20 or less, particularly 10 or less, cyclodextrin groups or derivatives thereof is used.

EXAMPLES OF THE PRESENT DYE COMPOUND telomer, introducing cyclodextrin groups or derivatives thereof into the telomer thus obtained, and then introducing a dye portion into the telomer. The synthesis of the dye portion can be accomplished by any suitable method as described in F.M. Hamer, *Heterocyclic Compounds—Cyanine Dyes and Related Compounds,* John Wiley & Sons Corporation (New York, London, 1964), and D.M. Sturmer, *Heterocyclic Compounds—Special Topics in Heterocyclic Chemistry,* Chapter 8, Paragraph 4, pp. 482–515, John Wiley & Sons Corporation (New York, London, 1977).

The introduction of cyclodextrin groups or derivatives thereof can be accomplished by a process which comprises a direct reaction with the hydroxy group of the cyclodextrin groups to form an ester bond or ether bond, a process which comprises replacing the hydroxy group of the cyclodextrin groups by arylsulfonate, and then reacting the cyclodextrin groups with carboxylate to form an ester bond, a process which comprises fur-

1.

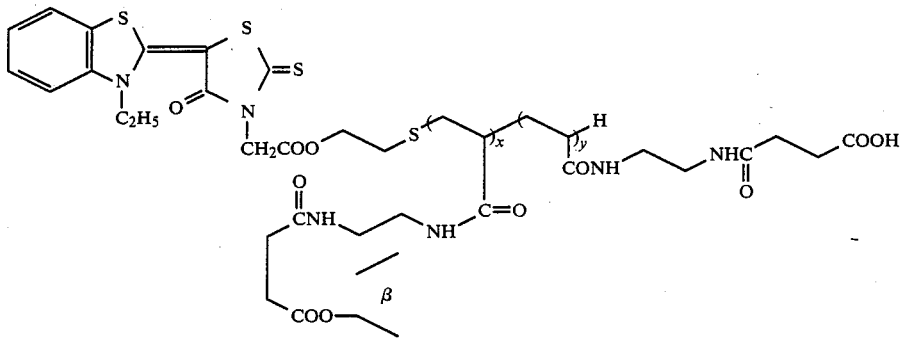

x = 6
y = 4

2.

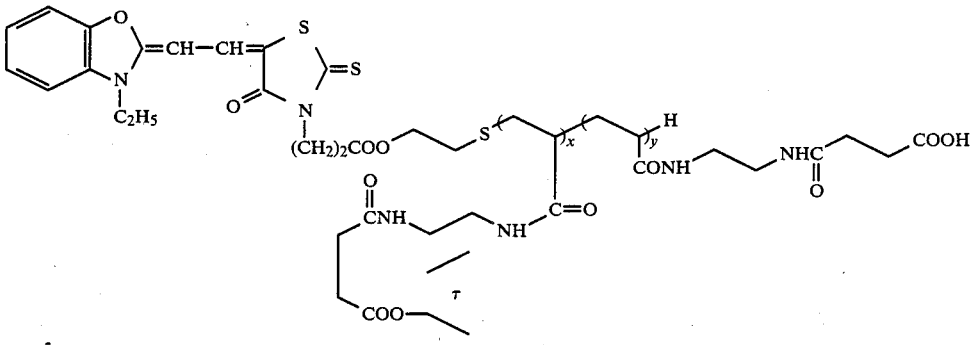

x = 5
y = 5

3.

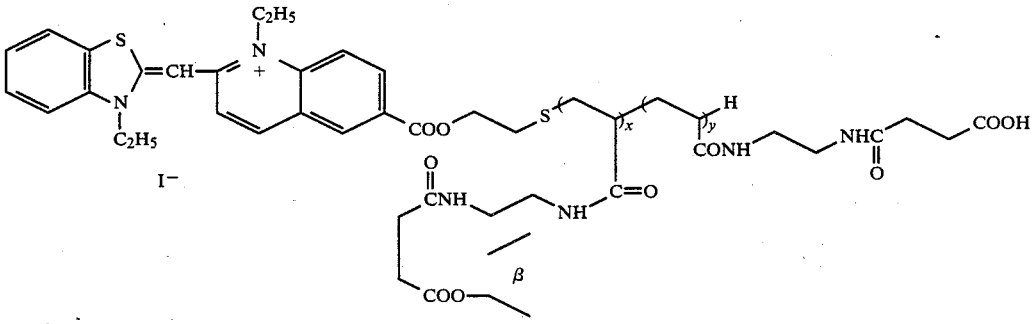

x = 3
y = 5

The synthesis of these compounds can be accomplished by a process which comprises synthesizing a ther replacing arylsulfonate by an amino group, or a process which comprises further forming an amide bond from said amino group.

These processes are described in detail in R. Breslow and L.E. Overman, *J. Am. Chem. Soc.*, 92, page 1075 (1979); Y Matsui, T. Yokoi and K. Mochida, *Chem. Lett.*, page 1037 (1976).

The synthesis of the telomers can be accomplished by a process which comprises dissolving a monomer and a thiol (thiol containing amino or hydroxy groups, preferably 2-aminoethanethiol and 2-hydroxyethanethiol) in ethanol, adding a polymerization initiator, such as azobisisobutylonitrile, to the solution, and then heating the admixture to a temperature of 60° to 70° C. In this case, the proportion of the monomer to the thiol can be determined in accordance with the polymerization degree of the desired telomer. The amount of the polymerization initiator is preferably 0.1 to 1 mol% based on the monomer.

The formation of the bond in each portion can be easily accomplished by any suitable method as described in S.R. Sandler and W. Karo, *Organic Functional Group Preparations,* Academic Press (New York, London, 1968).

Examples of the fluorescent compound which is used in combination include a polymethine compound such as cyanine and merocyanine, a phenooxadine compound, a xanthene compound, an aridine compound, an oxazole compound, a stilbene compound, a coumarin compound, a flavin compound, an anthracene compound, a naphthalene compound, a triphenylmethane compound, and a porphyrin compound.

A particularly preferred embodiment of the present invention is a light-responsive material comprising a dye containing two or more cyclodextrin groups or derivatives thereof and a compound which fluorescences light a wavelength which can be absorbed by said dye.

Specific non-limiting examples of the fluorescent compounds of the above series will be shown hereinafter.

Polymethine compound

1.

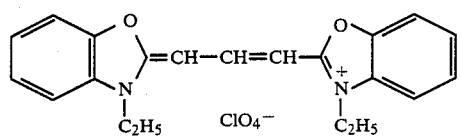

2.

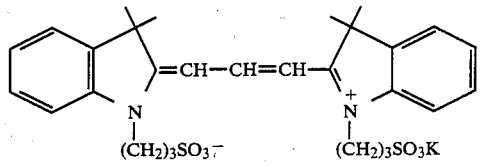

3.

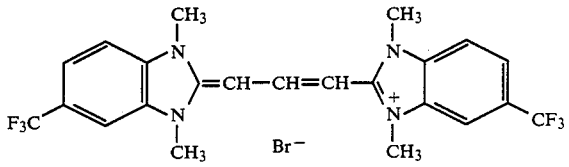

4.

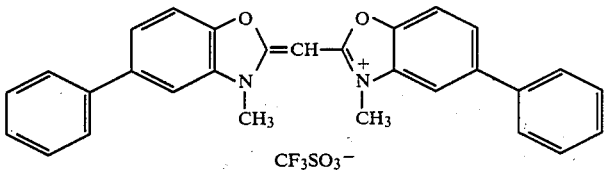

5.

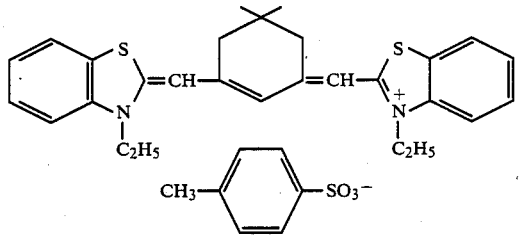

6.

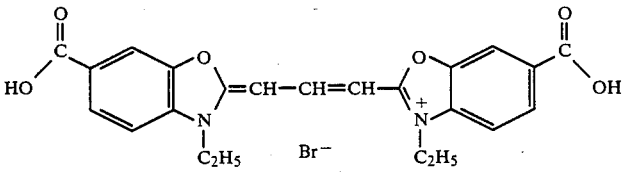

-continued
Phenooxadine compounds
1.
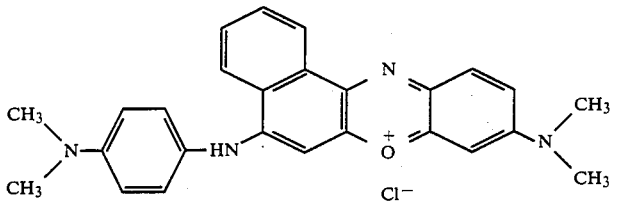
2.
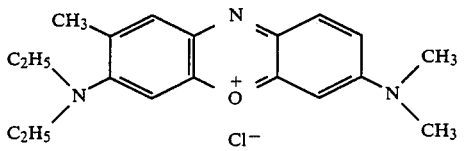
3.
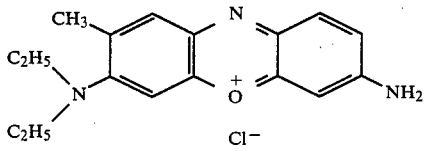
4.
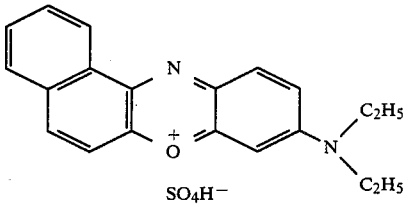
5.
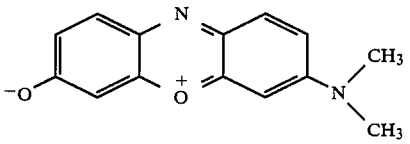
Xanthene compounds
1.
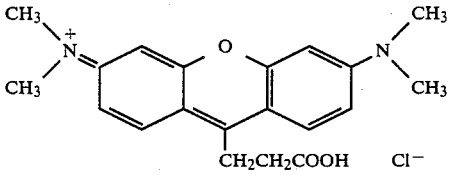
2.
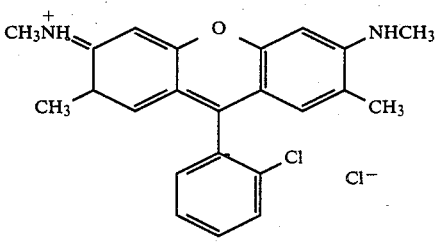
3.
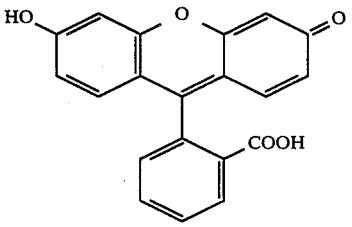

-continued
4.
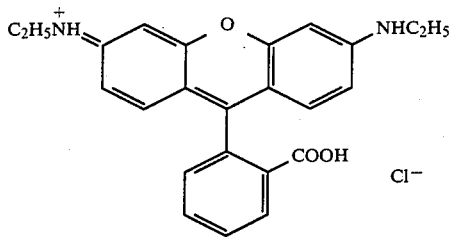
5.
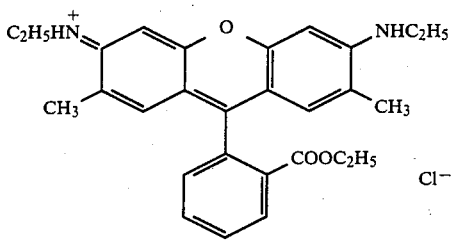
Acridine compounds
1.
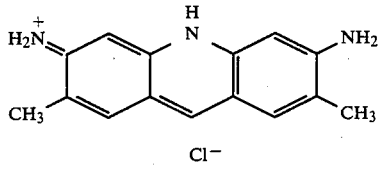
2.
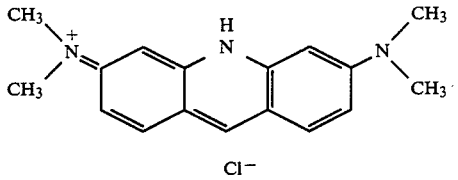
3.
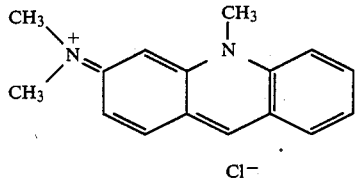
4.
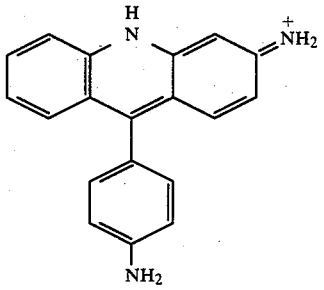
5.
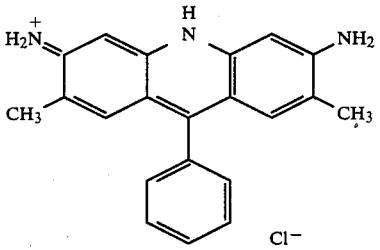

-continued
Oxazole compounds
1.
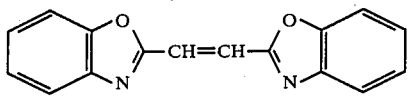
2.
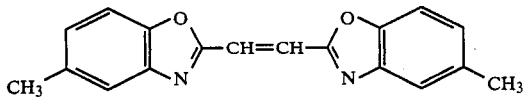
3.
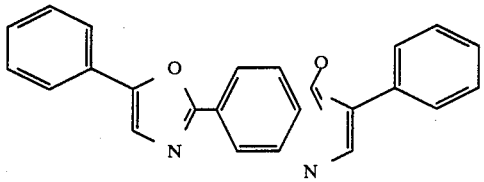
4.
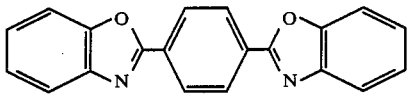
5.
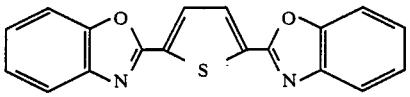
Stillbene compounds
1.
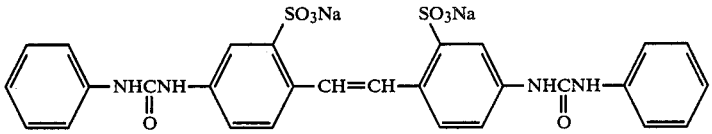
2.
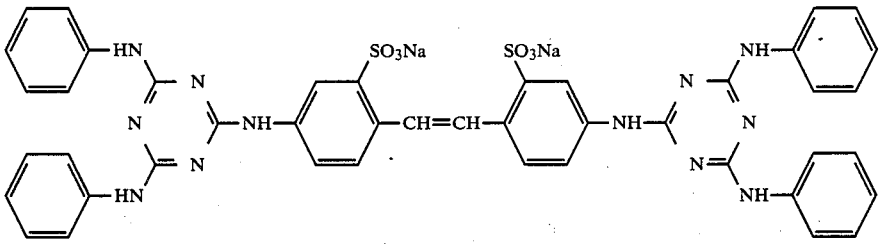
3.
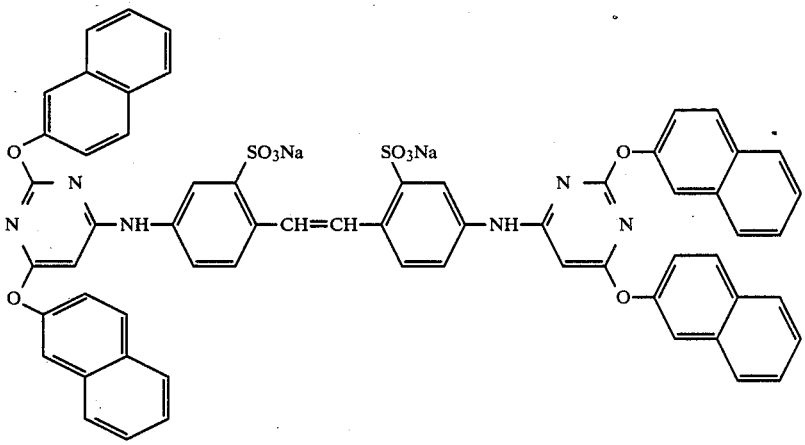

-continued
4.
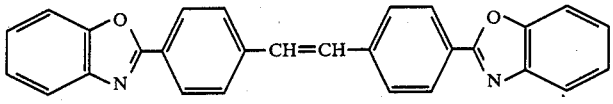
5.
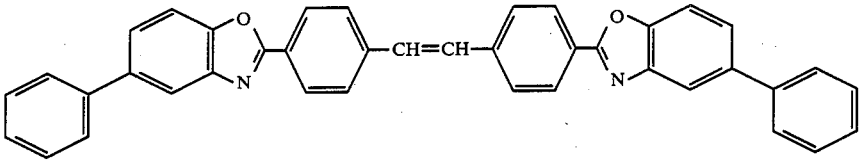
Coumarin compounds
1.
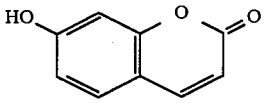
2.
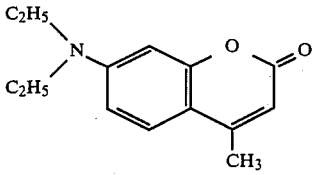
3.
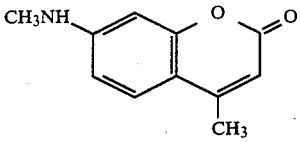
4.
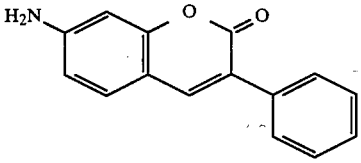
5.
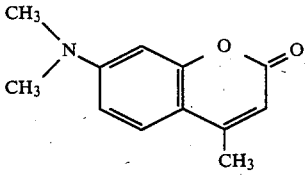
Triphenylmethane compounds
1.
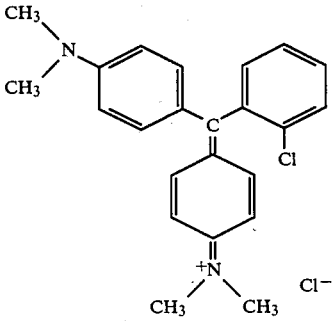

-continued
2.
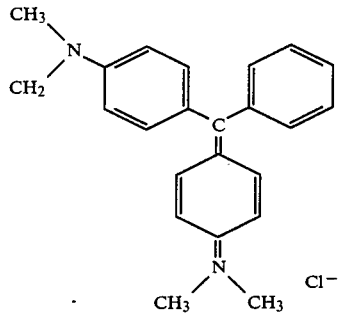
3.
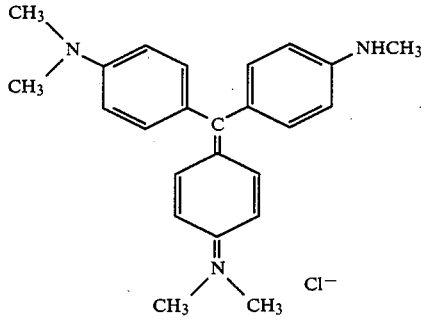
4.
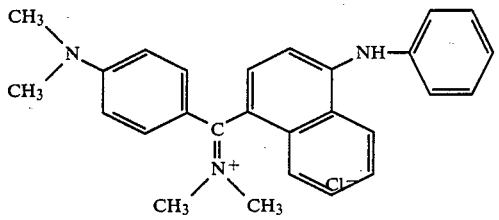
5.
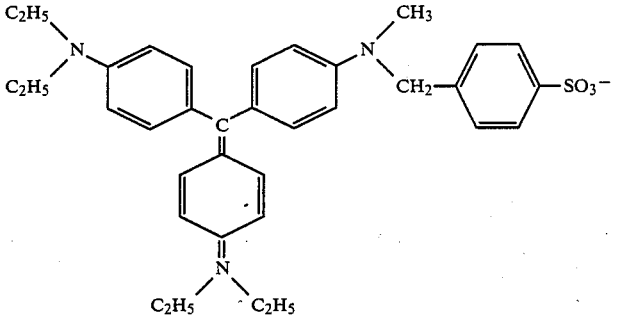
Porphyrin compounds
1.
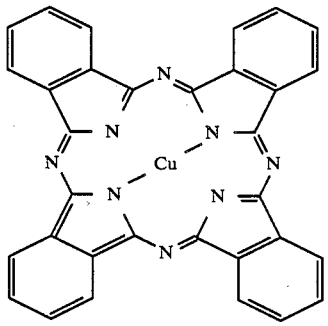

-continued

2.

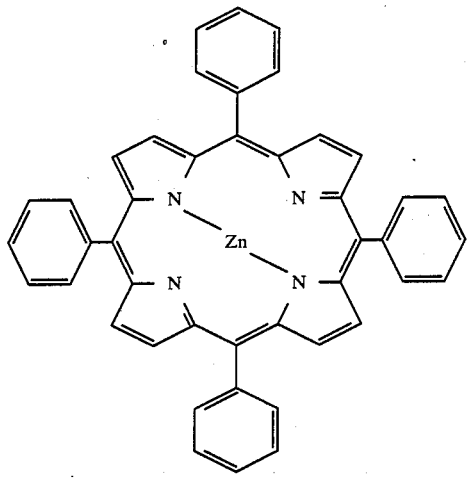

Chlorophyll

3.

In the present invention, the light-responsive material in which a dye compound is incorporated is not specifically limited. Preferred examples of the present light-responsive material include a material comprising an inorganic photosemiconductor such as silver halide, zinc oxide, titanium oxide, cadmium sulfite, zinc sulfate, selenium, or alloy of selenium and terbium or an organic photosemiconductor such as polyvinylcarbazoles and arylamines.

In the present invention, the amount of the dye compound and the fluorescent compound to be used can be properly determined depending on the specific usage of the light-responsive material. When the above-mentioned dye compound is used as a spectral sensitizing agent, the amount of the dye compound to be incorporated in the silver halide emulsion is generally $1\times10^{-6}$ to $5\times10^{\times3}$ mol, preferably $1\times10^{-5}$ to $2.5\times10^{-3}$ mol, more preferably $4\times10^{-5}$ to $1\times10^{-3}$ mol per mol of silver halide and the amount of the dye compound to be incorporated in the material comprising, for example, zinc oxide, titanium oxide, zinc sulfate or cadmium sulfate is generally 0.0005 to 20 parts by weight, preferably 0.001 to 1.0 part by weight per 100 parts by weight of the photosemiconductor. The amount of the fluorescent compound is 10 to 1,000 times, preferably 10 to 100 times that of the dye compound.

The dye compound and fluorescent compound to be incorporated in the present light-responsive material can be directly dispersed in a light-responsive material such as in a silver halide emulsion. These compounds can be incorporated in the light-responsive material in the form of a solution in a proper solvent such as methyl alcohol, ethyl alcohol, methyl cellosolve, water, pyridine, and a mixture thereof. The process for the incorporation of these compounds can be accomplished by means of a space regulator as described in A. Ueno et al, *J. Chem. Soc. Chem. Comm.*, page 194 (1981).

If the light-responsive material is a silver halide emulsion, the incorporation of these compounds can be accomplished by the following method. Particularly, the dissolution can be accomplished by ultrasonic waves. The incorporation of the dye compound in the light-responsive material can be accomplished by a process described in U.S. Pat. No. 3,469,987 which comprises dissolving a dye compound in an inorganic volatile solvent, dispersing the solution in a hydrophilic colloid, and then adding the dispersion to an emulsion, a process described in Japanese Patent Publication No. 24185/71 which comprises dispersing a water-insoluble dye compound in a water-soluble solvent without dissolution, and then adding the dispersion to an emulsion, a process described in U.S. Pat. No. 3,822,135 which comprises dissolving a dye compound in a surface active agent, and then adding the solution to an emulsion, a process described in Japanese Patent Application (OPI) No. 74624/76 which comprises dissolving a dye compound in a compound which causes red shift, and then adding the solution to an emulsion, and a process described in Japanese Patent Application (OPI) No. 80826/75 which comprises dissolving a dye compound in an acid substantially free of water, and then adding the solution to an emulsion. Alternatively, the incorporation of the dye compound in an emulsion can be accomplished by a process as described in U.S. Pats. Nos. 2,912,343, 3,342,605, 2,996,287, and 3,429,835.

If the light-responsive material is an inorganic photosemiconductor, the incorporation of the dye compound and fluorescent compound to be used in the light-responsive material can be accomplished by a conventional manner. Particularly, the incorporation of these compounds can be practically accomplished by a process which comprises dispersing a photosemiconductor into a binder resin, and then adding a solution containing the dye compound and fluorescent compound into the dispersion or a process which comprising first incorporating a photosemiconductor into a solution containing the dye compound and fluorescent compound to adsorb the dye, and then dispersing the solution into a binder resin.

One or more dye compounds and fluorescent compounds to be used in the present invention can be incorporated into a light-sensitive layer, alone or in combination. In a case where zinc oxide, which is one of a photosemiconductor, is used, it may be added an acid anhydride (e.g., a phthalic acid anhydride, etc.) to improve spectral sensitivity, and it may be further added conventional various additives for an electrophotographic light-sensitive layer.

As a binder to be used in combination, all conventionally known binder is utilized. Typical examples thereof include a vinyl chloride-vinyl acetate copolymerizate, a styrene-butadiene copolymerizate, a styrene-butyl methacrylate copolymerizate, a polymethacrylate, a polyacrylate, a polyvinyl acetate, a polyvinyl butyral, an alkyd resin, a silicone resin, an epoxy resin, an epoxy ester resin, a polyester resin, etc. These binders may be used in combination with an aqueous acryl emulsion or an aqueous ester emulsion.

Generally, it is possible to change the amount of binder resin to be used in the photosemiconductor compositions according to the present invention. Typically, the useful amount of binder resin to be incorporated is from about 10 to 90 wt%, preferably from 15 to 60 wt% based on the total amount of .admixture of the photosemiconductor material and the binder resin.

Since sensitizing dyes are generally weak to oxidization, it is desired to avoid using a catalytic compound or the like compound which accelerates the oxidation. Among a vinyl polymerization initiator, it should be carefully used, for example, a peroxide such as benzoyl peroxide and an organic acid salt of heavy metals which accelerates the curing of unsaturated aliphatic acids, and so on. In this respect, even the sensitizing dye which is used in the present invention should be carefully used as the conventional sensitizing dye.

An electrophotographic light-sensitive layer of the present invention can be coated on a conventional support. Generally, it is preferable that the support for the electrophotographic is conductive. Typical examples thereof include a metal plate, a plastic film coated a conductive layer (i.e., which is coated with a thin layer of an aluminium, a palladium, an indium oxide, a tin oxide, a cuprous iodide, etc.), and a conductive treated paper. As a conductive treating agent for paper, a polymer containing a quaternary ammonium salt (e.g., a polyvinylbenzyltrimethylammoniumchloride, a polymer containing a quaternary nitrogen at the main chain as described in U.S. Pat. Nos. 4,108,802, 4,118,231, 4,126,467, and 4,137,217 and Japanese Patent Application (OPI) No. 20977/79 (cf. U.S. Pat. No. 4,147,550 and *Research Disclosure,* No. 16258)), a sulfonic acid salt of polystyrene, a colloidal alumina, etc. are well known. Usually, these conductive treating agents are used with a polyvinyl alcohol, a styrene-butadiene latex, a gelatin, a casein, etc.

As an organic solvent for dispersion, a volatile hydrocarbon solvent having a boiling point of 200° C. or lower is used, particularly a halogenated hydrocarbon containing 1 to 3 carbon number (e.g., a dichloromethane, a chloroform, a 1,2-dichloroethane, a tetrachloroethane, a dichloropropane, and a trichloroethane, etc.) is preferred. In addition, it is possible to use an aromatic hydrocarbon (e.g., a chlorobenzene, a toluene, a xylene, a benzene, etc.), a ketone (e.g., an acetone, a 2-butanone, etc.), an ether (e.g., a tetrahydrofuran, etc.), a methylene chloride, and various solvents which are used for coating compositions as well as a mixture of the above-mentioned solvents. The amount of these solvents to be used in the present invention is from about 1 to 100 g, preferably from about 5 to 20 g per g of total amount of the dye, the photosemiconductor and other additives.

The coat thickness on a support of the photosemiconductor composition according to the present invention can be widely changed. Usually, it is coated in a range of from about 10 μm to 300 μm (but it is before drying). The preferred coat thickness has been turned out to be within a range of from about 50μm to 150 μm. If, however, the amount is out of the range, useful results can be obtained. The dry coat thickness is from about 1μm to 50μm.

The photosemiconductor composition of the present invention can be used as a light-sensitive layer (a light conductive layer) for a single layer type electrophotographic light-sensitive material, in addition to, as a charge carrier generating layer for a function dispersing type electrophotographic light-sensitive material including a charge carrier generating layer and an electroncharge carrier transporting layer, and as a photoconductive composition for a photo electrophoretic electrophotographic method or a photconductive grain contained therein.

One or more dye compounds of the present invention can be incorporated in the light-responsive material, alone or in admixture.

The present dye compound can be used in combination with other sensitizing dyes as described in U.S. Pats. No. 3,703,377, 2,688,545, 3,397,060, 3,615,635, 3,628,964, 3,416,927, 3,615,613, 3,615,632, 3,617,295, and 3,365,721, British Patents 1,242,588 and 1,293,862, and Japanese Patent Publication Nos. 4936/68, 14030/69, 10773/68, and 4930/68.

The silver halide emulsion to be used in the present invention can be generally prepared by mixing a solution of a water-soluble silver salt such as silver nitrate with a solution of a water-soluble halide salt such as potassium bromide in the presence of a water-soluble high molecular compound solution such as gelatin. Suitable silver halides which may be used include silver chloride, silver bromide, or a mixed silver halide such as silver chlorobromide, silver iodobromide, and silver chloroiodobromide. The average particle size of the particulate silver halide in terms of the average based on the projected area (determined by particle diameter in the case of a spherical or nearly spherical particle or edge length in the case of a cubic particle) is preferably 4 μm or less. The distribution of particle sizes may be narrow (i.e., "monodisperse") or wide.

The shape of such a particulate silver halide grain may be any one of cube, tetradecahedron, dodecarhombohedron, octahedron, mixed crystal shape, sphere, plate, and the like.

Alternatively, an emulsion in which super tabular silver halide grains having a diameter 5 or more times than their thickness fall within 50% or more of the total projected areas can be used. Specific examples of such an emulsion are described in Japanese Patent Application (OPI) Nos. 127921/83 and 113927/83.

Alternatively, two or more silver halide photographic emulsions which have been separately prepared may be mixed to obtain a desired emulsion. Furthermore, the crystal structure of the present silver halide grains is such that the halogen composition is uniform from the outer surface of the inner portion or such that the halogen composition is different from the outer surface to the inner portion to form a layer structure. Alternatively, the crystal structure of the present silver halide grain may be of a so-called conversion type as described in British Pat. No. 635,841 and U.S. Pat. No. 3,622,318. The present photographic silver halide emulsion may be of the surface latent image type in which a latent image is formed mainly on the surface of the grains or of the internal latent image type in which a latent image is formed mainly in the internal portion of the grains.

The preparation of these photographic emulsions may be accomplished by any suitable method as described in T.H. James, *The Theory of the Photographic Process* (4th ed.), MacMillan Publishing, Inc. (1976), P. Glafkides, *Chimie et Physique Photographique* (Paul Montel, 1967), G.F. Duffin, *Photographic Emulsion Chemistry* (The Focal Press, 1966), and V.L. Zelikman et al, *Making and Coating Photographic Emulsion* (The Focal Press, 1964). Particularly, the present photographic emulsions can be prepared by any one of the acidic process, neutral process, and ammonia process. The reaction of the soluble silver salt with the soluble halogen salt may be accomplished by a single jet process, a double jet process, or a combination thereof.

The preparation of the present photographic emulsions may be accomplished by a process which comprises forming grains in excess silver ions (the so-called reversal mixing process). An example of the double jet process is a so-called controlled double jet process in which the pAg of the liquid phase in which the silver halide is formed is kept constant. This process allows the preparation of an emulsion of particulate silver halide having a regular crystal shape and a nearly uniform particle size.

Two or more silver halide emulsions which have been separately prepared may be mixed before use.

The present silver halide emulsion may be used as a so-called primitive emulsion which is not subjected to chemical sensitization. However, the present silver halide emulsion is normally subjected to chemical sensitization. The chemical sensitization may be accomplished by any suitable method as described in P. Glafkides, *Chimie et Physique Photographique* (Paul Montel, 1967), V.L. Zelikman et al, *Making and Coating Photographic Emulsion* (The Focal Press, 1964), and H. Friesel, *Die Grundlagen der Photographischen Prozesse mit Silberhalogeniden* (Akademische Verlagsgesellscaft, 1968).

Particularly, a sulfur sensitization process using an active gelatin or a sulfur-containing compound capable of reacting with silver (e.g., thiosulfate, thioureas, mercapto compounds, and rhodanines), a reduction sensitization process using a reducing material such as a stannous salt, amines, hydrazine derivatives, formamidinesulfinic acid, and silane compounds, and a noble metal sensitization process using a nobel metal compound such as a gold compound and complex salt of the group VIII metals, e.g., platinum, iridium, palladium can be used, alone or in combination.

As a binder or protective colloid for the present light-sensitive material there can be advantageously used gelatin. Other hydrophilic colloids can also be used. Suitable gelatins include lime-processed gelatin, acid-processed gelatin, or gelatin derivatives.

If the present light-responsive material is a silver halide photographic emulsion, other various additives can be used. Examples of such additives include coloring agents such as yellow couplers, magenta couplers, and cyan couplers, fog inhibitors, stabilizers such as 1-phenyl-5-mercaptotetrazole, and 4-hydroxy-substituted (1,3,3a,7)-tetraazaindene, desensitizers, hardening agents such as 1,3,5-triacryloyl-hexahydro-s-triazine, and 2,4-dichloro-6-hydroxy-s-triazine, coating aids, antistatic agents, plasticizers, lubricants, matting agents, development accelerators, oils such as phthalic alkylesters, and phosphoric esters, mordants, ultraviolet absorbers, antifading agents such as hydroquinone derivatives, color fog inhibitors such as hydroquinone derivatives, and antibacterial agents such as 2-thiazolylbenzimidazoles, and isothiazolones. As such derivatives there can be used those as described in *Research Disclosure,* No. 17643, pp. 22–31 (December, 1978).

The emulsions thus finished are coated on a support such as baryta paper, resin-coated paper, synthetic paper, triacetate film, polyethyleneterephthalate film, other plastic bases, or glass plate. Various coating processes such as a dip coating process, an air knife coating process, a curtain coating process, and an extrusion coating process using a hopper as described in U.S. Pat. No. 2,681,294 can be used to prepare the photographic light-sensitive material.

Examples of photographic light-sensitive materials to which the present photographic emulsion can be applied include various color and black-and-white light-sensitive materials.

Specific examples of such light-sensitive materials include color negative films for use in general photographing or movie shooting, color reversal films for use in slides or movies (optionally free of couplers), color photographic papers, color positive films for use in movies, color reversal photographic papers, heat-developable color light-sensitive materials, color light-sensitive materials using a silver dye bleach process, photographic light-sensitive materials for use in plate-making such as lithographic film and a scanner film, X-ray photographic light-sensitive materials for direct or indirect medical use or industrial use, black-and-white negative films for photographing, black-and-white photographic papers, micro light-sensitive materials for COM and microfilm, color diffusion transfer photographic materials such as DTR, silver salt diffusion transfer light-sensitive materials, and printout light-sensitive materials.

If the present light-responsive material is a light-sensitive material, its photographic processing can be accomplished by any conventional method using any conventional processing solution. The processing temperature can be generally selected between 18° C. and 50° C. but may be lower than 18° C. or higher than 50° C. The black-and-white developing process for forming silver images or the color photographic developing process for forming dye images can be applied depending on the purpose.

Such development processes are described in detail in *Research Disclosure,* No. 17643, pp. 28–30 (December, 1978).

In accordance with the present invention, a novel dye compound comprising a dye containing two or more cyclodextrin groups or derivatives thereof or further comprising a compound which fluoresces light of a wavelength which can be absorbed by said dye can be used to obtain a light-responsive material providing an improved spectral sensitization effect and showing an improved sensitivity. This effect becomes remarkable when such a fluorescent compound is used in combination. This effect is believed to be caused by an increase in the light absorption developed when the light energy absorbed by the fluorescent compound is transmitted to the dye as a fluorescence.

The present invention will be further illustrated in the following example, but the present invention should not be construed as being limited thereto. Unless otherwise indicated herein, all parts, percents, ratios and the like are by weight.

EXAMPLE

Photographic emulsions were prepared by adding a dye compound (1) of the present invention in the amounts shown in Table 1 below to a silver chlorobromide emulsion (silver chloride content: 70 mol%, silver bromide content: 30 mol%) which had been prepared in a usual manner. Further photographic emulsions were prepared by further adding a fluorescent compound (f1) and a conventional sensitizing dye (A) to the above silver chlorobromide emulsions, respectively. These photographic emulsions were each coated on a triacetate cellulose base to prepare Sample Nos. 2 to 7. Furthermore, an emulsion free of sensitizing dye was coated on a triacetate cellulose base in the same manner to prepare Sample No. 1.

A part of each of these samples were wedgewide exposed to light from a light source having a color temperature of 2,854° K., and the remaining part was exposed to light for a spectrogram by means of a diffraction grating type spectrograph.

After exposure to light, these samples were subjected to development at a temperature of 20° C. for 2 minutes with a developing solution of the composition set forth below. The density of these samples were then measured by a densitometer (products of Fuji Photo Film Co., Ltd.) to obtain sensitivity and fog values. The standard point on the optical density by which the sensitivity was determined was the point [fog +1.5]. The results are shown as relative values in the Table 1.

| Composition of Developing Solution | |
|---|---|
| Water | 700 ml |
| Metol | 3.1 g |
| Anhydrous sodium sulfite | 45 g |
| Hydroquinone | 12 g |
| Sodium carbonate (monohydrate) | 79 g |
| Potassium bromide | 1.9 g |
| Water to make | 1 l |

The developing solution thus prepared was added to water in a volume ratio of 1:2 for use.

TABLE 1

| Sample No. | Sensitizing Dye and Amount Added ($\times 10^{-5}$ mol/kg emulsion) | | Amount Added of Fluorescent Compound ($\times 10^{-4}$ mol/kg emulsion) | | Relative Sensitivity | Fog | Remarks |
|---|---|---|---|---|---|---|---|
| 1 | — | | — | | 100 | 0.05 | Standard |
| 2 | 1 | 16 | — | | 185 | 0.05 | Invention |
| 3 | " | 32 | — | | 191 | 0.05 | " |
| 4 | " | 16 | f1 | 16 | 205 | 0.05 | " |
| 5 | " | 16 | " | 32 | 210 | 0.05 | " |
| 6 | A | 16 | — | | 181 | 0.05 | Comparison |
| 7 | " | 32 | — | | 166 | 0.05 | " |

Chemical structure of dye (A) used in the comparative sample

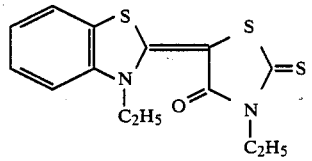

Fluorescent compound (f1)

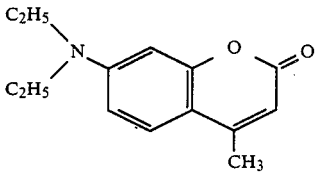

As apparent from the above Table 1, the present invention provides a light-responsive material having an improved sensitivity.

While the invention has been described in detail and with reference to specific embodiments thereof, it will be apparent to one skilled in the art that various changes and modifications can be made therein without departing from the spirit and scope thereof.

What is claimed is:

1. A light-responsive material comprising a lightsensitive material containing therein a dye containing two or more cyclodextrin groups or derivatives thereof.

2. The light-responsive material as claimed in claim 1, wherein said material additionally comprises a compound which fluoresces light of a wavelength which can be absorbed by said dye.

3. The light-responsive material as claimed in claim 1, wherein said dye serves as a spectral sensitizer.

4. The light-responsive material as claimed in claim 1, wherein said material is a light-sensitive silver halide material and said dye is incorporated in a silver halide emulsion in an amount of $1\times10^{-6}$ to $5\times10^{-3}$ mole per mol of silver halide.

5. The light-responsive material as claimed in claim 4, wherein said dye is incorporated in a silver halide emulsion in an amount of $1\times10^{-5}$ and $2.5\times10^{-3}$ mole per mol of silver halide.

6. The light-responsive material as claimed in claim 5, wherein said dye is incorporated in a silver halide emulsion in an amount of $4\times10^{-5}$ to $1\times10^{-3}$ mole per mol of silver halide.

7. The light-responsive material as claimed in claim 2, wherein said material is a light-sensitive silver halide material and said compound which fluoresces light is incorporated in a silver halide emulsion in an amount of 1 to 1000 times that of the dye.

8. The light-responsive material as claimed in claim 7, wherein said compound which fluoresces light is incorporated in a silver halide emulsion in an amount of 10 to 100 times that of the dye.

9. The light-responsive material as claimed in claim 1, wherein said cyclodextrin group or derivative thereof is a group derived form a member selected from the group consisting of α-cyclodextrin, β-cyclodextrin, γ-cyclodextrin and derivatives thereof.

10. The light-responsive material as claimed in claim 1, wherein said dye contains 2–20 of said cyclodextrin groups or derivatives thereof.

11. The light-responsive material as claimed in claim 10, wherein said dye contains 2–10 of said cyclodextrin groups or derivatives thereof.

12. The light-responsive material as claimed in claim 2, wherein said compound which fluoresces light is selected from the group consisting of a polymethine compound, a phenoxadine compound, a xanthene compound, an acridene compound, an oxazole compound, a stilbene compound, a coumarin compound a flavin compound, an anthracrene compound, a naphthalene compound, a triphenylmethane compound and a porphyrin compound.

* * * * *